US006326599B1

(12) United States Patent
Pickford

(10) Patent No.: US 6,326,599 B1
(45) Date of Patent: Dec. 4, 2001

(54) MICROWAVE OVEN FOOD RECEPTACLE

(75) Inventor: Keith Pickford, Manchester (GB)

(73) Assignee: Novus Foods Ltd., Manchester (GB)

( * ) Notice: Subject to any disclaimer, the term of this patent is extended or adjusted under 35 U.S.C. 154(b) by 0 days.

(21) Appl. No.: 09/381,848

(22) PCT Filed: Mar. 27, 1997

(86) PCT No.: PCT/GB97/00924

§ 371 Date: Apr. 13, 2000

§ 102(e) Date: Apr. 13, 2000

(87) PCT Pub. No.: WO97/36797

PCT Pub. Date: Oct. 9, 1997

(30) Foreign Application Priority Data

May 30, 1996 (GB) ..... 9606813

(51) Int. Cl.[7] ..... H05B 6/80

(52) U.S. Cl. ..... 219/725; 219/730; 264/633; 264/641; 99/DIG. 14

(58) Field of Search ..... 219/725, 730, 219/732, 759; 264/633, 640, 641; 99/DIG. 14; 426/107, 109, 234, 241, 243

(56) References Cited

U.S. PATENT DOCUMENTS

| | | | | |
|---|---|---|---|---|
| 4,393,088 | * | 7/1983 | Matsusaka | 426/234 |
| 4,864,089 | * | 9/1989 | Tighe et al. | 219/730 |
| 4,908,487 | * | 3/1990 | Sarnoff et al. | 219/725 |
| 5,088,179 | | 2/1992 | Gibbon . | |
| 5,093,176 | * | 3/1992 | Pribonic et al. | 428/76 |
| 5,565,132 | * | 10/1996 | Salyer | 252/70 |

FOREIGN PATENT DOCUMENTS

| | | |
|---|---|---|
| 0 344 726 A2 | 12/1989 | (EP) . |
| WO 94/19917 | 9/1994 | (WO) . |
| WO 94/27887 | 12/1994 | (WO) . |
| WO 95/24110 | 9/1995 | (WO) . |
| WO 96/22228 | 7/1996 | (WO) . |

* cited by examiner

*Primary Examiner*—Philip H. Leung
(74) *Attorney, Agent, or Firm*—Beyer Weaver & Thomas LLP

(57) ABSTRACT

A microwave oven food container in the form of a receptacle for foodstuffs. The receptacle is composed of a polymeric material containing a microwave absorbent filler, which may comprise carbon or metal particles.

4 Claims, No Drawings

MICROWAVE OVEN FOOD RECEPTACLE

This invention relates to utensils of the type suitable for use in a microwave oven. The invention relates particularly but not exclusively to food containers which can be placed in a microwave oven to heat or reheat a food product.

Microwave ovens are quick and convenient for cooking or heating of foods. In particular ready prepared foods can be reheated in a matter of minutes. This has lead to the creation and rapid growth of "convenience foods"—ready prepared foods or meals which have been cooked or partially cooked and which only require reheating in a microwave oven. Convenience foods may be packaged in containers which are suitable for use in a microwave oven, obviating any need to empty the food into another container for reheating. Some products are packaged in such a way that the reheated food can be eaten directly from the container, which container may be disposed of after use.

According to a first aspect of the present invention a microwave oven food container comprises a receptacle for a foodstuff, the receptacle being composed of a polymeric material including a radiation absorbent filler.

The filler may comprise carbon, for example particulate carbon black or comminuted carbon fibres or mixtures thereof. Metal particles may also be employed as a filler.

Preferred polymeric materials include polyolefins including polyethylene, polypropylene, polyethylene teraphthalate and copolymers and blends thereof.

Use of a food grade of polypropylene is preferred, for example NOVALEN 1102J (BASF).

Preferred polymeric materials may be pigmented with carbon black. For example a master blend of polypropylene and carbon black may be prepared for dilution with further polypropylene to give a desired loading of the carbon filler. For example polypropylene may be blended with carbon black in a particle size of 20 nm to give a 40% loading. The master blend may be diluted to give a loading of 2 to 20% in the final product.

Use of a radiation absorbent filler, for example particulate carbon has been found to increase the heating efficiency of a microwave oven. Reflection and absorption of radiation reduces formation of cold spots in the food product. Furthermore the container can become hot during irradiation so that heat transmission from the container to the food product may continue after cessation of the irradiation cycle. Drying and crisping are enhanced in comparison to an unfilled container.

In a preferred embodiment of the invention the receptacle comprises a base and one or more sides. The base may be generally flat or planar but may be formed with recesses and raised portions. Our copending application PCT/GB96/00128 discloses an arrangement wherein a multiplicity of protrusions extending from the base are arranged to support the food product, facilitating reflection and deflection of microwave and thermal radiation towards the latter.

In preferred embodiments of the invention the container comprises a receptacle and a closure, preferably a lid. The closure may be secured to the receptacle by means of a hinge and may be adapted to be closed by means of a catch, clip or other arrangement. The container and closure may be arranged to define one or more apertures adapted to permit egress of steam from the container in use.

According to a second aspect of the invention a microwave oven utensil is composed of a polymeric material including a radiation absorbent filler as described above. The utensil may comprise a container, tray or cover for use in a microwave oven.

According to a third aspect of the present invention there is provided use of a polymeric material including a radiation absorbent filler, preferably carbon for manufacture of a microwave oven container or other utensil.

The invention is further described by means of example but not in any limitative sense.

Sheet polymeric material was formed containing 2%, 5%, 10% and 20% of a master batch of polypropylene. Up to 40% of carbon may be employed, ie undiluted master batch. The sheet material was formed into D2 type trays. The master batch comprised 40% food grade carbon black and 60% NOVALEN 1102J food grade polypropylene.

Tests were carried out to demonstrate the heating of food products in comparison to conventional unfilled polypropylene trays of the same dimensions. The conventional trays were coloured yellow. Decreased cooking times and elimination of cold spots were observed using the carbon filled polypropylene trays.

EXAMPLE 1

Fish Fingers

Fish fingers having an average weight of 16 g were pre-cooked to a temperature of 11.6° C., placed off-centre in a microwave oven and the temperature was measured after cooking for one minute. The results are shown in Table 1.

TABLE 1

| | Unfilled Polymer | 0.8% C | 2% C | 4% C | 8% C |
|---|---|---|---|---|---|
| Temperature at Centre/° C. | 86.9 | 88.8 | 84.7 | 86.8 | 85.2 |
| Temperature at Edge/° C. | 77 | 89.8 | 84.9 | 84 | 82.6 |

The fish fingers in the unfilled polymer tray were found to be more dehydrated than those in the filled polymer trays.

EXAMPLE 2

Turkey Burgers

Commercially available turkey burgers with a weight of 220 g for five pieces, ie average 44 g each, were pre-cooked for 1 min to −30° C. and placed in trays off-centre in a microwave oven. The results are shown in Table 2.

TABLE 2

| | Unfilled Polymer | 0.8% C | 2% C | 4% C | 8% C |
|---|---|---|---|---|---|
| Temperature at Centre/° C. | 19.7 | 25.5 | 33.5 | 35.5 | 28.1 |
| Temperature at Edge/° C. | 66.5 | 75 | 68.9 | 69.5 | 72 |
| Weight/g | | 38 | 42 | | 42 |

EXAMPLE 3

Cream Cheese

Samples of cream cheese/200 g starting temperature 11° C. were heated in a microwave oven and the results were as follows. Yellow and blue pigmented unfilled trays were used for comparison.

| Cooking Time | | Yellow Unfilled Polymer | Blue Unfilled Polymer | 20% C |
|---|---|---|---|---|
| 1 min | Centre ° C. | 35° C. | 36° C. | 38° C. |
| | Edge | 44° C. | 44° C. | 44° C. |
| 2 min | Centre | 44° C. | 44° C. | 48° C. |
| | Edge | 62° C. | 64° C. | 58° C. |
| 3 min | Centre | 50° C. | 52° C. | 52° C. |
| | Edge | 73° C. | 78° C. | 70° C. |

What is claimed is:

1. A method of manufacturing a microwave oven utensil comprising the steps of:

(i) blending a carbon microwave absorbing filler with a polyolefin material to form a master batch having a carbon microwave absorbent filler content of 40% by total weight;

(ii) blending the master batch with further polyolefin material, to produce a diluted blend of polyolefin material having a carbon filler material content not more than 8% by total weight of the diluted blend; and (iii) forming the diluted blend of polyolefin material into a microwave oven utensil.

2. A method as claimed in claim 1, in which the carbon filler content of the diluted blend is not more than 4% by total weight of the diluted blend.

3. A method as claimed in claim 2, in which the carbon filler content of the diluted blend is not more than 2% by total weight of the diluted blend.

4. A method as claimed in claim 2, in which the carbon filler content of the diluted blend is not more than 0.8% by total weight of the diluted blend.

* * * * *